US006988927B2

(12) United States Patent
Gingold et al.

(10) Patent No.: US 6,988,927 B2
(45) Date of Patent: Jan. 24, 2006

(54) JUMPING CAN TOY

(76) Inventors: Moti Gingold, Haim Ve Elisha 10 St., Tel Aviv (IL); Amit Nuillin, 40 Ela St., Raut (IL)

( * ) Notice: Subject to any disclaimer, the term of this patent is extended or adjusted under 35 U.S.C. 154(b) by 0 days.

(21) Appl. No.: 10/770,401

(22) Filed: Feb. 4, 2004

(65) Prior Publication Data

US 2005/0170745 A1 Aug. 4, 2005

(51) Int. Cl.
*A63H 30/00* (2006.01)

(52) U.S. Cl. ..... 446/175; 446/236; 446/77; 446/308; 273/359

(58) Field of Classification Search ..... 446/175, 446/236, 77, 308–312, 330; 273/359, 369–371; 283/386; 434/22, 21, 19, 16; 40/414, 415
See application file for complete search history.

(56) References Cited

U.S. PATENT DOCUMENTS 3,119,201 A * 1/1964 Brown et al. ..... 446/175
4,662,845 A * 5/1987 Gallagher et al. ..... 434/22
4,970,810 A * 11/1990 Liou ..... 446/175
4,983,890 A * 1/1991 Satoh et al. ..... 446/175
5,221,224 A * 6/1993 Satoh et al. ..... 446/175
5,303,491 A * 4/1994 Satoh et al. ..... 446/74
5,505,652 A * 4/1996 Click ..... 446/353
5,941,756 A * 8/1999 Chou ..... 446/330
2002/0164921 A1 * 11/2002 Wilkinson et al. ..... 446/308
2003/0064661 A1 * 4/2003 Herber ..... 446/310

FOREIGN PATENT DOCUMENTS

GB 2229646 A * 7/1990

* cited by examiner

*Primary Examiner*—Derris H. Banks
*Assistant Examiner*—Urszula M Cegielnik
(74) *Attorney, Agent, or Firm*—Lilling & Lilling P.C.

(57) ABSTRACT

A simple two-piece interactive toy has one part made as a simulated gun that transmits an infrared signal. The other piece is a spring-loaded can. When the can receives the infrared signal from the gun, the internal spring mechanism is activated to shift an internal weight. This causes the can to impulsively jump.

15 Claims, 16 Drawing Sheets

JUMPING CAN TOY

FIELD OF THE INVENTION

This invention relates to the entertainment or toy industry and, in particular, relates to an interactive toy that moves or jumps up and down.

BACKGROUND OF THE INVENTION

For literally millennium, people have always configured toys or other entertainment devices out of the objects at hand. As technology grew more sophisticated, so did the toys. Nearly 50 years ago, one of the favorite toys was a simple round hoop of plastic, whereas today one of the favorite toys is an arcade type game that can be played on your television or computer screen.

Since the dawn of the electronic ages, electrical toys have been common. Early versions necessarily had a cord of some kind from the control box to the toy. With time the cord has disappeared and wireless control units are now frequently used.

Various kinds of toys are operated by remote control, such as cars, boats, skateboards, and some robots. There are other toys that can walk, jump or make a noise (usually animals).

What is missing is a simple interactive toy, which permits a child (or even an adult) to simulate a shooting action and then have a can (or other object) move or jump in response to the shooting action.

SUMMARY OF THE INVENTION

This and other objects of the invention are obtained by a simple two-piece interactive toy. One part is a simulated gun that transmits an infrared signal. The other piece is a spring-loaded can. When the can receives the infrared signal from the gun, the internal spring mechanism is activated to shift an internal weight. This causes the can to impulsively jump.

This idea is of making a toy out of two units, one shaped like a can and the other one is like a pistol. The purpose of the game is to shoot and "hit" the can with the pistol. Every time the can has been hit, it will jump and fall back on its bottom surface, while making a noise like a bullet hitting it. It will be possible to hit the can a few times one after the other.

It is another object of the present invention to provide a toy that can be played by every one over 5 years old. The toy itself is based on a combination electronic and mechanic device. One can activate the can by aiming the pistol towards it and shooting it (i.e. sending a beam). Once the beam is received and identified by the can, the can will jump, make a noise like a bullet hit and then land back on its surface ready for the next shot (or beam) to activate it.

An electronic mechanical game is made out of two units, one is an operating device that sends or transmits an electronic signal that activates the other device for jumping and making a sound. The second device can look like a can or whatever desired object, with a device inside that, after receiving a signal, jumps and makes a noise.

The toy may be implemented with an infrared transmitter or gun that makes noises and sends a beam to the can. In the can, there are sensors for beam sensing. Once the beam is sensed by the sensors, the can jumps, makes a noise, and lands on the bottom surface ready again for the next signal.

The can has an electronic device that triggers the mechanical mechanism that causes the jump, and then reloads the mechanical device.

DETAILED DESCRIPTION OF THE INVENTION

The invention is of a mechanism that causes a can or other means to jump up from a surface without any mechanical elements going out of it in order to cause the jumping. Its concept is based upon a sliding weight that is stretched down (reloading process) and then, when released, moves up at a high speed. When the weight's potential energy hits the top of the can, it pushes the can up, and this cause the jumping effect.

Figure 10:
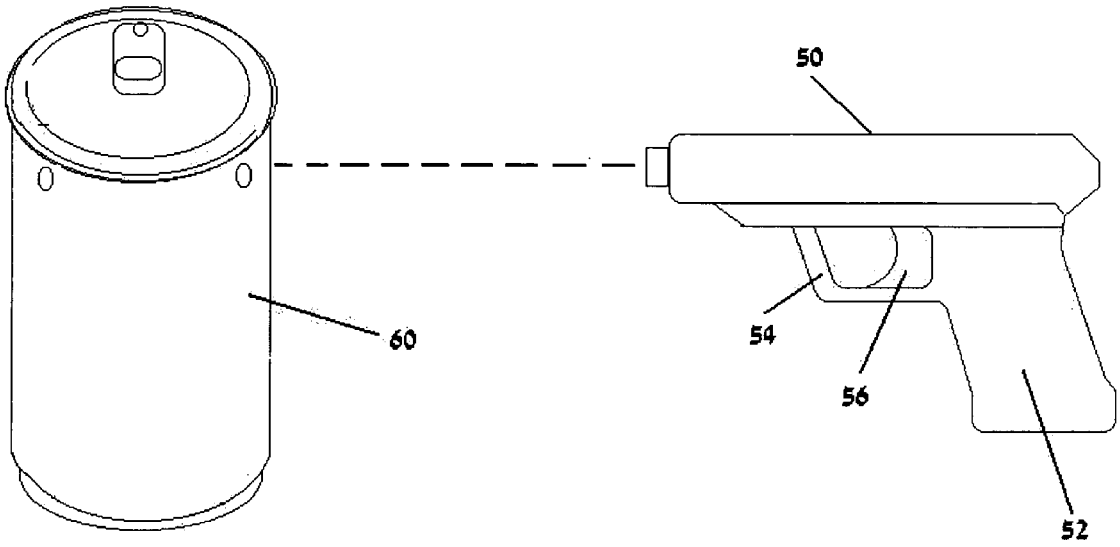
FIG. 10 is a perspective view showing the receiving and transmitting pieces of the invention.
Figure 11:
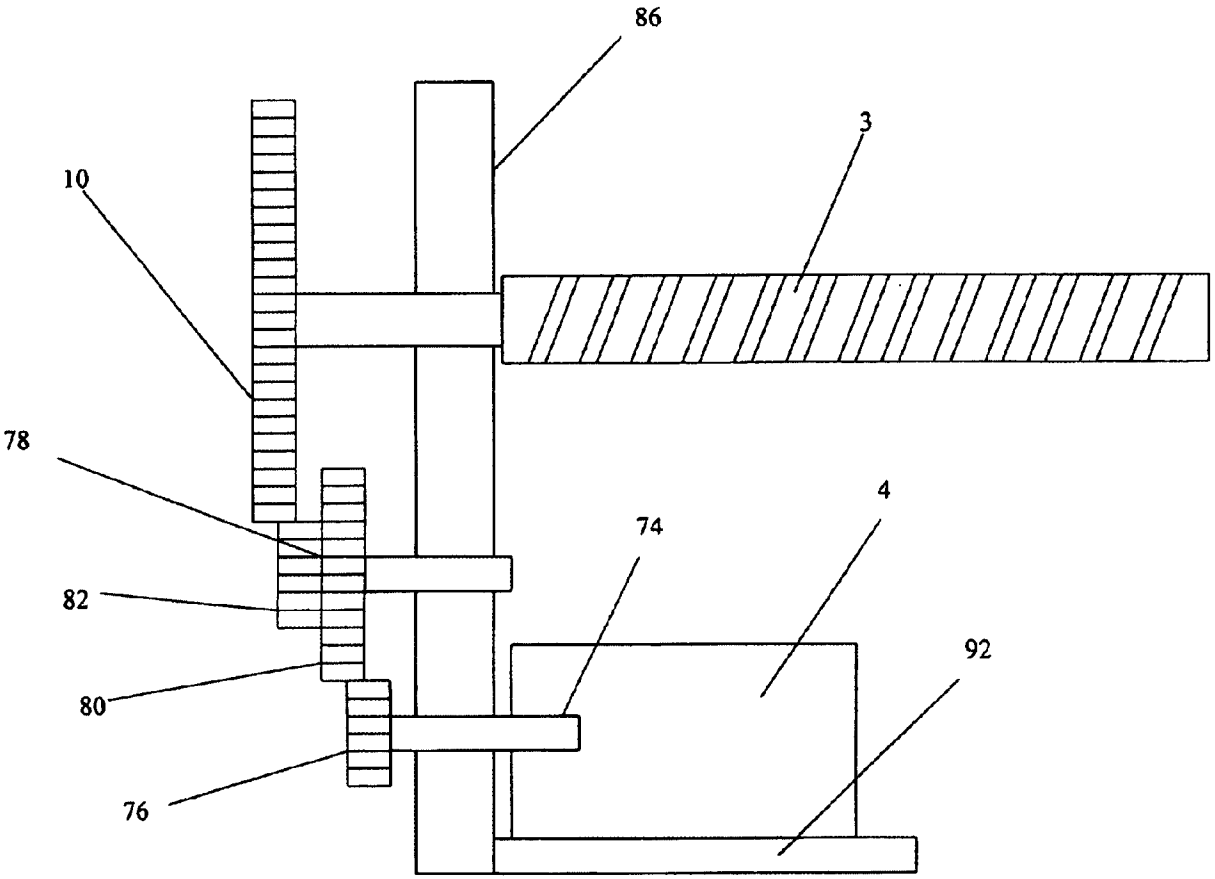
FIG. 11 is an enlarged view of the gear train to power the threaded shaft 3.

As best shown in FIG. 10, this interactive toy has two distinct elements.

First, there is a transmitting device 50. This can be implemented in any desired shape, style or format. In the embodiment shown herein, it is illustrated as a gun with a standard shape, including a handle 52, trigger guard 54, trigger 56, and barrel. A futuristic space gun, like those used in Star Wars or Star Trek, may also be used. Since it is electronic, there should be a battery compartment for batteries, which, in this embodiment, is enclosed by a battery cover.

The exact configuration is not critical, since the device merely emits unseen infrared waves. No missiles or projectiles are shot out, so shape is more for the point of making it a fun toy, as opposed to making it an effective shooting implement.

As will be hereinafter explained, by engaging some button or switch on the surface of the transmitter, an infrared wave is generated. In the illustrated transmitter, the gun trigger 56 fulfills this role.

The second element of the interactive toy is the jumping unit. This can be made in any desired shape or size. For purposes of illustration, it is shown in FIG. 10 as a can. Thus, the interactive toy simulates shooting cans in the air. The can may also be shaped as a bottle or a rock or any other desired device that would be considered fun to shoot so it moves up and down.

Inside the can 60, there is an electromechanical, battery powered, mechanism, which is controlled by an electronic circuit. The electronic circuit controls the direction of the motor 4 for reloading and receives signal for triggering the mechanism to jump.

The mechanism is built of a sliding weight 20 traveling up and down within the can. This weight includes the motor 4, metal rods 2*a*, 2*b*, threaded shaft 3, clutch springs 5*a*, 5*b*, clutch cogwheels 9*a*, 9*b*, plates 13 with slots 12*a*, 12*b*, and frame 8.

As shown, there is a stationery frame 7 is that does not rotate or otherwise move. It includes four vertical supports 62, which are secured to a lower base 64 within the can. On this same base, as will be hereinafter described, the electronic circuit board may be place and the batteries 11 are mounted in close juxtaposition to provide power to the circuitry.

Connecting the tops of the four vertical supports 62 of the frame is a top platform 66. A central opening 68 permits passage of the threaded shaft 3. As part of the moving weight 20, there is a movable frame 8. This frame has a bottom base 86 and a top plate 88, joined by four supports or columns 90 to define an unitary frame. A seat 92 is made on the base 86 to accommodate the motor 4 (and multiple seats may be defined if there are multiple motors). Openings 94 are made in base 86 to permit passage of the metals rods 2*a*, 2*b*. The threaded shaft 3 is aligned along the central axis of the frame 8 and its lower distal end 96 extends through a central opening 98 in the base 86.

Springs 5*a,b* may be provided around the shaft 3 between the plate 12*a* and the top plate 88 and between the plate 12*b* and the base 86.

The invention may be implemented with either one or two motors, as desired. As shown in the drawings, only one motor 4 is shown. In some versions, two motors may work more effectively, as they can provide more energy and thus greater jumping ability.

As is well known any suitable gear train is used to transmit rotational motion from the motor shaft to the threaded shaft 3. In the preferred embodiment, each motor has a drive shaft 74 with a pinion gear 76 on its end. These pinions (or pinion if there is only one motor) are in mesh with a control gear 78, which is rotatably mounted on the bottom surface of the base 86 of the frame 8. This control gear has a first gear 80 in mesh with the pinions (or pinion) and then a second gear 82, which is in mesh with a large gear 10. To provide the rotational motion to the threaded shaft, the large gear 10 is in mesh with a cogwheel 9*b*, which is secured on the bottom end 96 of the threaded shaft 3, so that the cogwheel and shaft rotate together. By this means, the threaded shaft rotates when the motor is activated and spins its output shaft.

The threaded shaft 3 when rotating travels up and down in the can, depending on the direction of rotation and the interconnection with the fixed half nuts 6*a*, 6*b*. These half nuts 6*a*, 6*b* and the whole weight mechanism travels up and down through those half nut 6*a*, 6*b*.

This mechanism for up and down movement is built of two parts of half nut 6*a*, 6*b*. When attached together, these two parts engage as one unit and act like one complete nut. When the two parts clamp the threaded shaft 3, the threaded shaft 3 with the frame 8, and other portions of the weight 20, travels down depending on the threaded shaft 3 rotating direction. When the two parts of the nut 6*a*, 6*b* separate apart, the threaded shaft 3 and weight 20 slides up through nut 6*a*, 6*b* since there is no contact with the threaded shaft 3.

The reloading (FIG. 4) (when weight goes down) and release (FIG. 6) (causing weight to jump up) of the mechanism depends on the state of the nut 6*a*, 6*b*. This means that, if the nut 6*a*, 6*b* is attached to the treaded shaft 3, the weight is moving down and is reloading; and, if the nut 6*a,b* is split apart, the stored energy of the springs 1*a,b* moves the weight up quickly to cause the jumping action. The state of the nut 6*a*, 6*b* is controlled by the rotating direction of the threaded shaft 3. When the threaded shaft 3 rotates clockwise, it tugs the nut 6*a*, 6*b* down and the whole weight 20 with it. When the shaft rotates counter clockwise, it cause the two parts of nut 6*a*, 6*b* to split at once and then the weight 20 is released from the threaded shaft 3 and jumps up. As may be understood, the specific direction of the threaded shaft depends on the direction of rotation of the motor.

As shown, the weight mechanism 20 is suspended from the top of the can with two springs 1*a*, 1*b*, tensioned when the weight travels down. When nut 6*a*, 6*b* splits apart, the weight mechanism releases and moves up by the stored energy in the springs 1*a*, 1*b*, which is created by the tension when the springs are stretched as the weight is moved down. One end 14 of the springs 1*a,b* is attached to the inner top surface of the can 60, and the other end 15 of the springs 1*a,b* is attached to the base 86 of the frame 8. Therefore, as the device is "loaded" and the weight 20 with the frame 8 moves down in the ca for loading, the springs 1*a,b* are stretched. Since the nuts 61,*b* are holding tightly around the thread shaft 3, thee can be no upward movement. Once the nuts 6*a,b* release the threaded shaft 3, there is nothing to hold the weight 20 and frame 8 and the stored energy in the springs 1*a,b* is released and the springs contract quickly, as is well know for springs. This rapid contraction of the springs, when the tension is removed, naturally causes the rapid movement of the weight 20 and frame 8. As the mechanism moves up, the top of the top plate 88 of the frame 8 strikes the inside of the top of the ca and cause the jumping action.

The nut splitting mechanism is built of the two parts of the nut 6*a*, 6*b*, two plates 13 with slots 12*a*, 12*b*, and two parallel sliding rods 2*a*, 2*b*. On the outer side edges of the nut 6*a*, 6*b* are ears 70 and these ears have openings 72 through which the sliding rods 2*a,b* may pass. When the sliding rods move towards the threaded shaft 3, they tighten the nut 6*a*, 6*b* to the threaded shaft 3. If the sliding rods 2*a*, 2*b* move away from the shaft, then the two parts of nut 6*a*, 6*b* move apart. This movement of the rods towards or away from the threaded shaft is caused by the two plates 13 with the slots 12*a*, 12*b* located at the two ends of the threaded shaft 3. The plates 13 have two curved slots 12 at the radius, and the ends of the rods 2 are located between the two plates and move inside the slots in a cam-like action. Since the rods engage the nut 6*a*, 6*b*, when the plates rotate, then the rods slide within the slots. Depending on rotating direction, this cause the rods to move towards or away from the shaft, thereby moving the nuts together or apart.

To permit movement of the plates 13 with the threaded shaft 3, the plates are fixedly secured to the shaft, so that the plates rotate with the shaft. This may be done in any suitable manner. One way is to make the pieces integral or to secure them with clue or any suitable adhesive. In the preferred embodiment, meshed cogwheels 9*a,b* are used. A toothed cogwheel 9*a,b* is fixedly secured to each end of the threaded shaft 3. On the mating surface of the plate, a matching cogwheel is secured. Thus, the plates would rotate with the shaft due to the cogwheels.

Figure 1A:
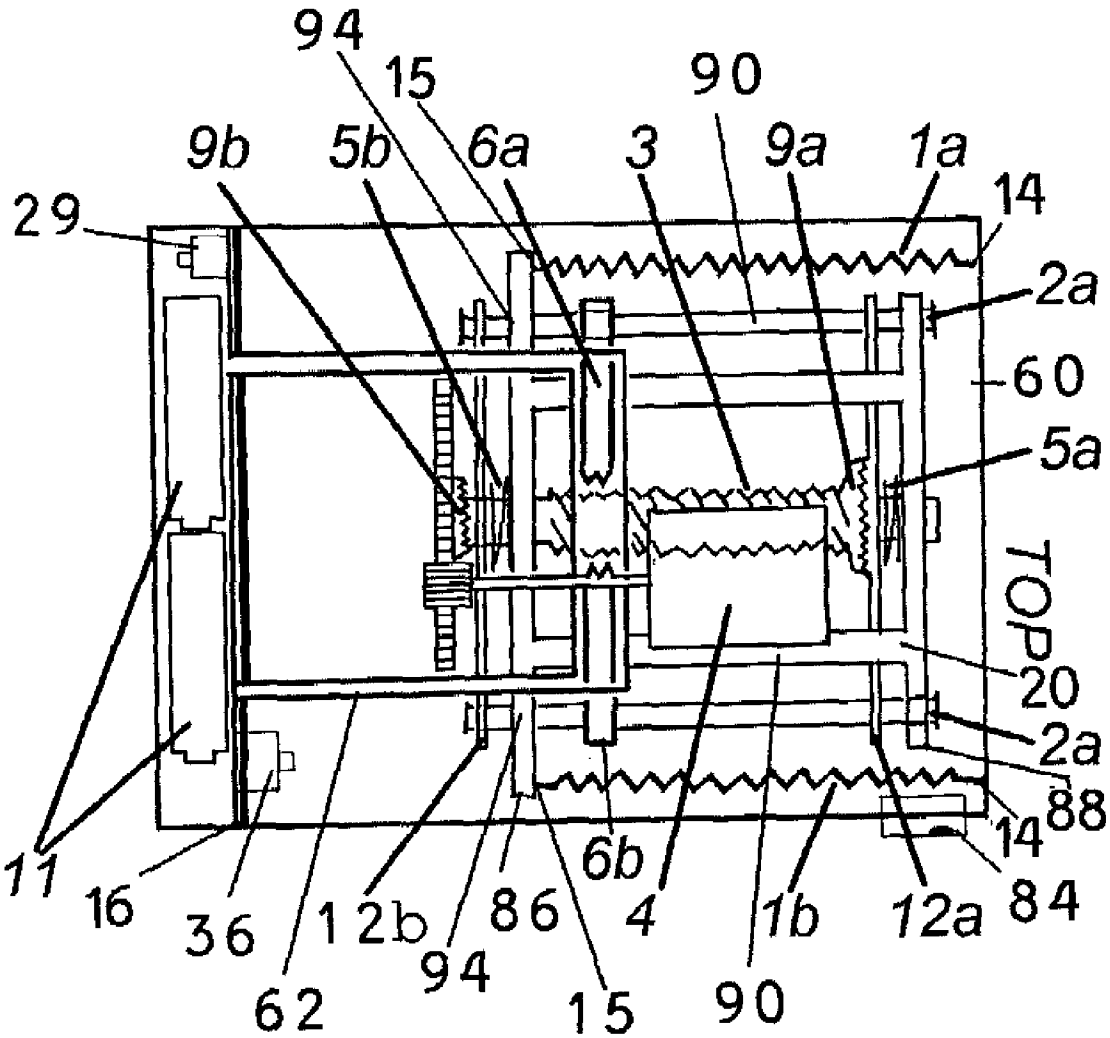
FIG. 1*a* is an elevational view of the inside of the jumping can portion of the invention, when the mechanism is up.
Figure 1B:
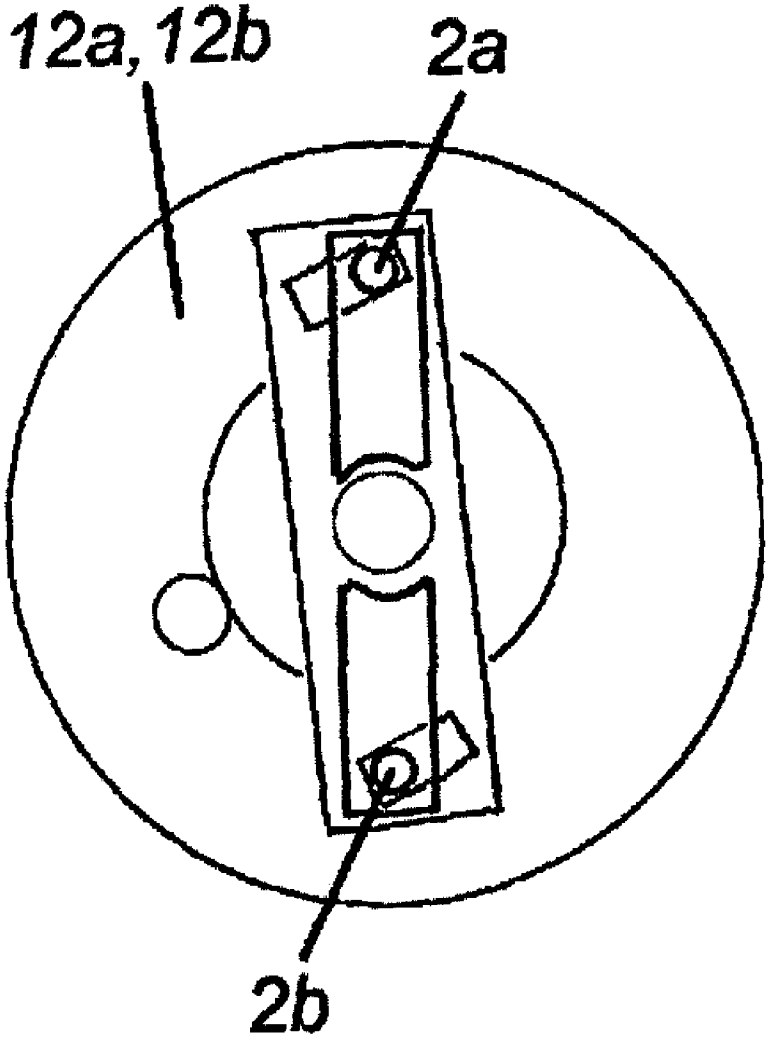
FIG. 1*b* is a top view of the plates with slots of the can shown in FIG. 1*a;*
Figure 2:
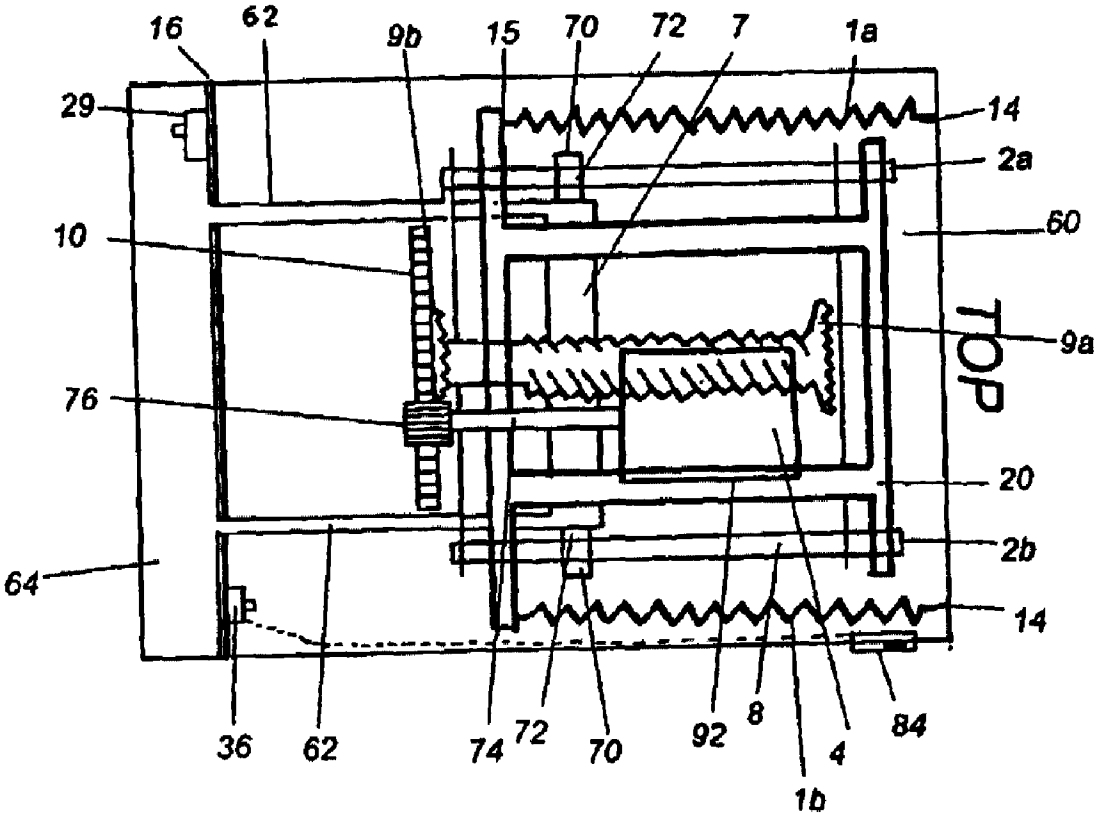
FIG. 2 is an elevational view of the inside of the jumping can portion of the invention, showing the connections between the motor and the threaded bolt.
Figure 3A:
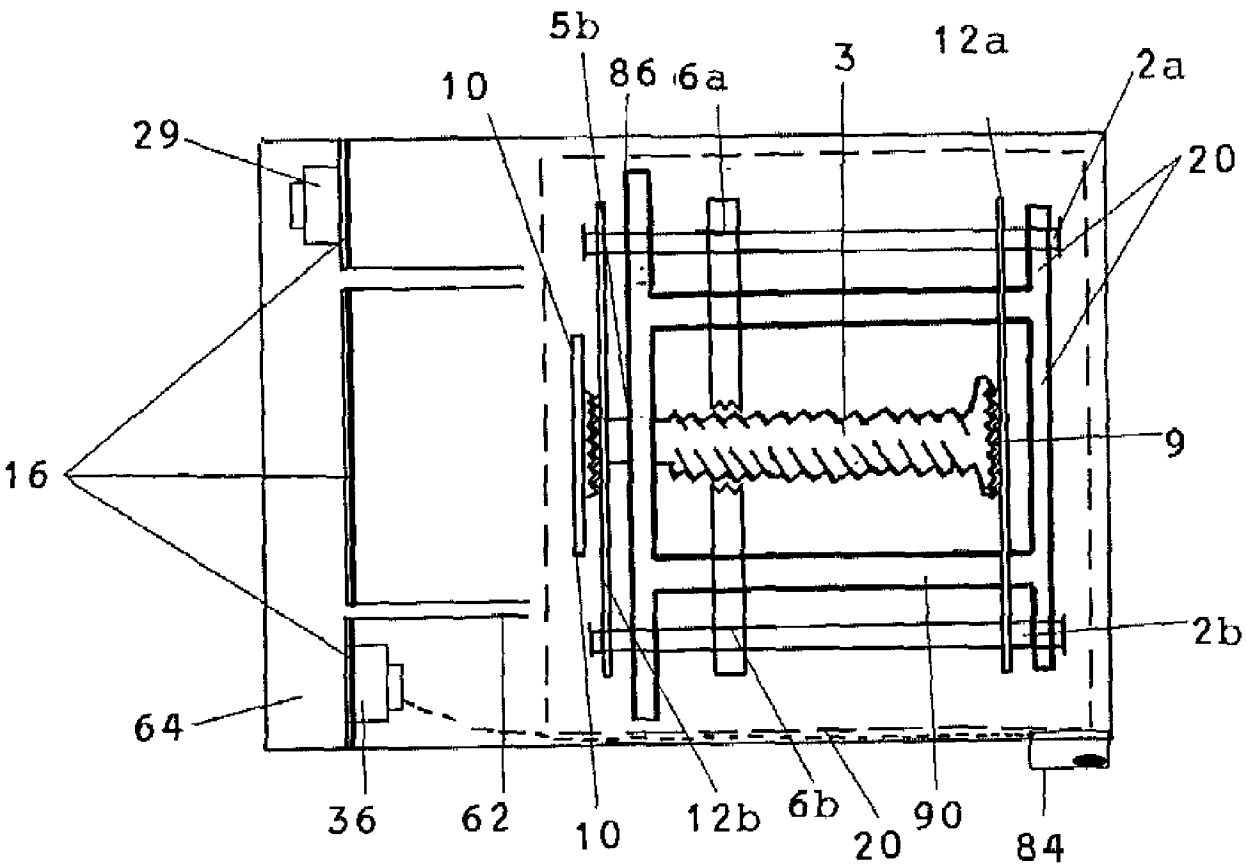
FIG. 3*a* is an elevational view of the inside of the jumping can portion of the invention, showing the connection between the two half-nuts and the threaded bolt.
Figure 3B:
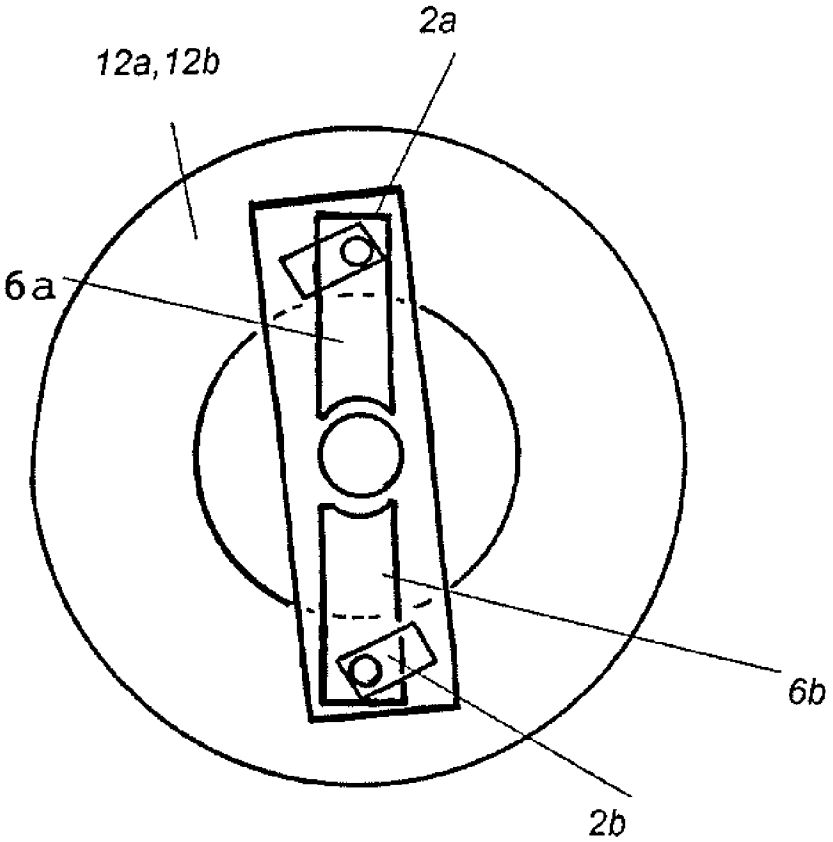
FIG. 3*b* is a top view of the plates with slots of the can shown in FIG. 3*a;*
Figure 4A:
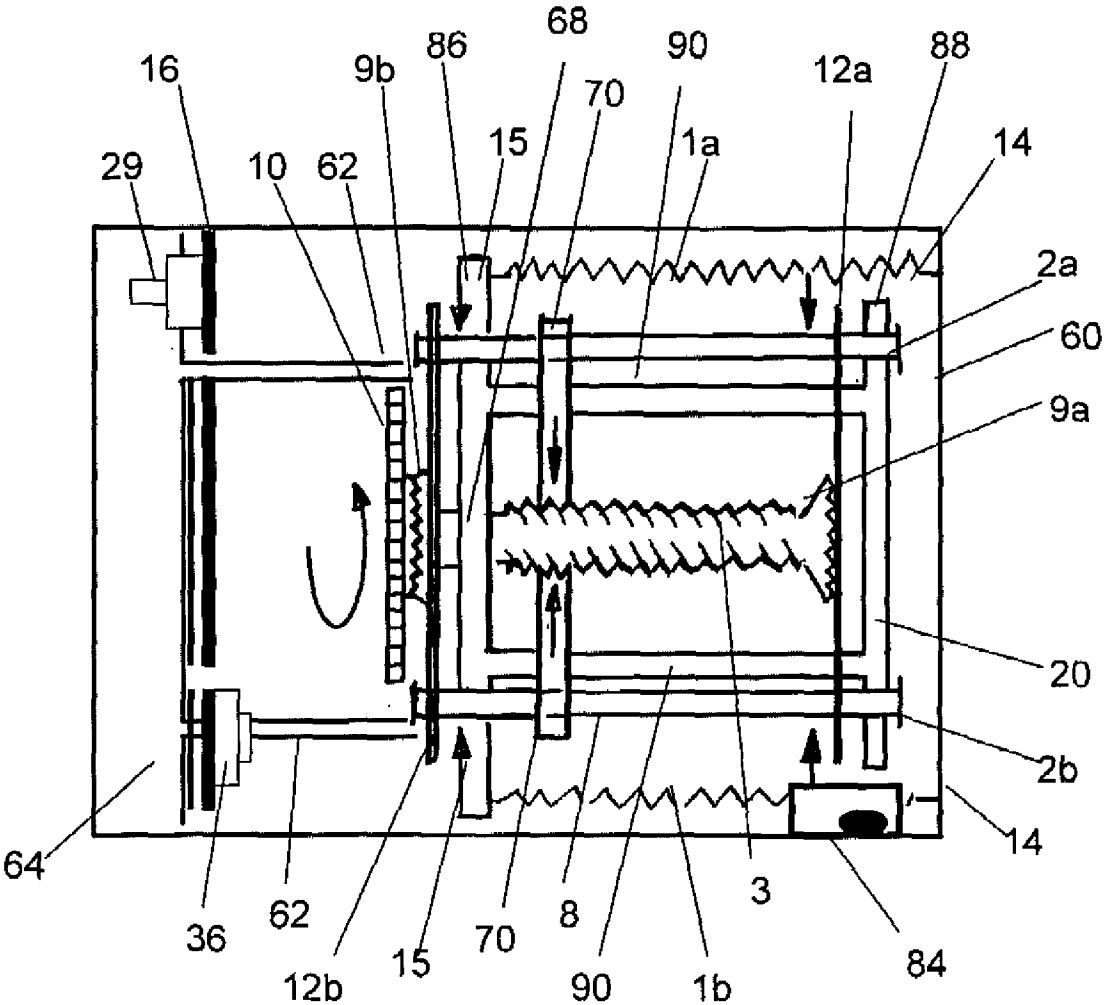
FIG. 4*a* is an elevational view of the inside of the jumping can portion of the invention, showing the clockwise turning of the threaded bolt.
Figure 4B:
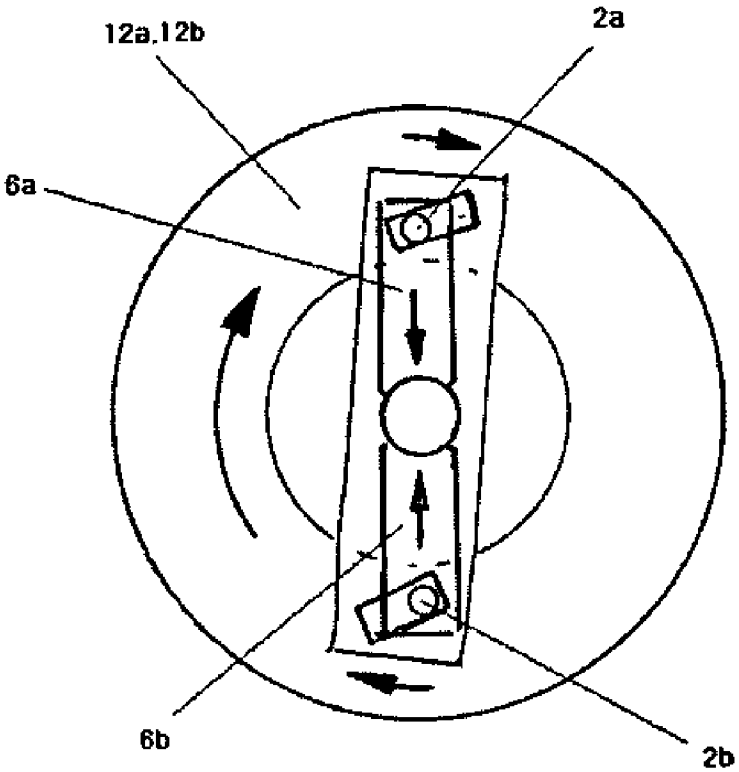
FIG. 4*b* is a top view of the can shown in FIG. 4*a;*
Figure 5A:
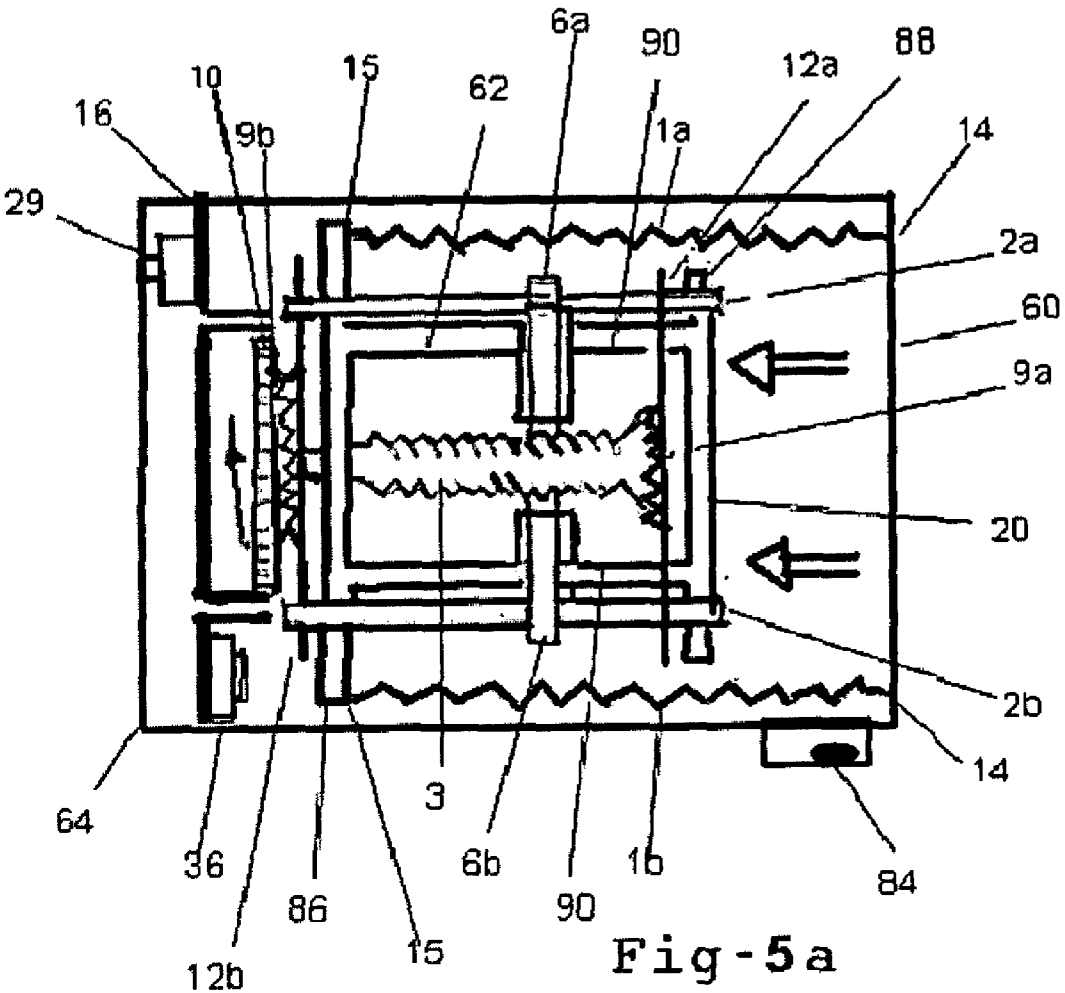
FIG. 5*a* is an elevational view of the inside of the jumping can portion of the invention, when the mechanism is traveling downward.
Figure 5B:
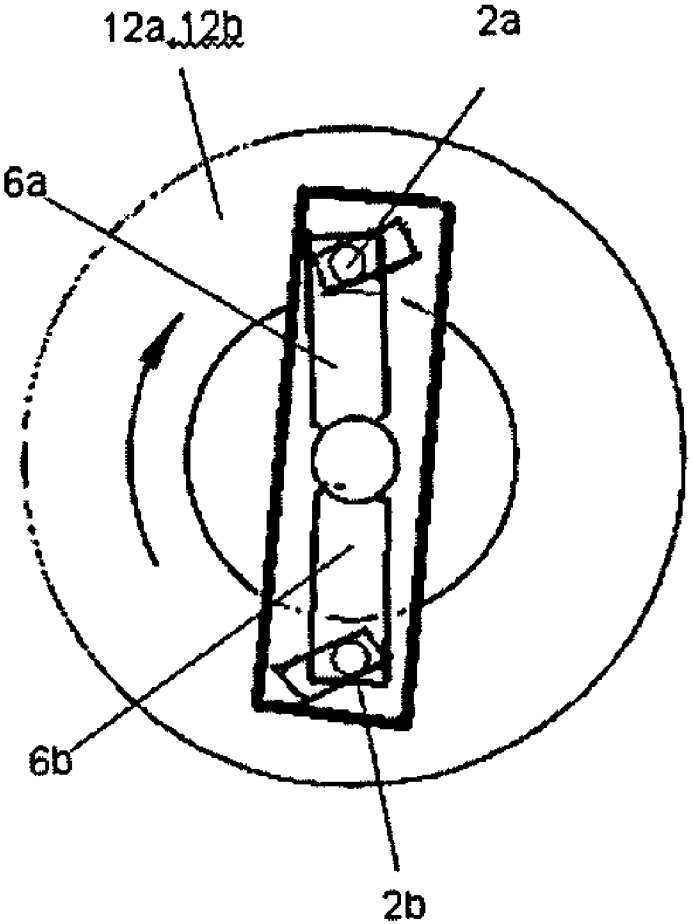
FIG. 5*b* is a top view of the plates with slots of the can shown in FIG. 5*a;*

FIG. 1 illustrates the mechanism. FIG. 2 shows the sliding weight part located at the top of can, when the springs are not in tension—before the reloading process. FIG. 3 shows the sliding weight part without motor and gear. FIG. 4 shows the beginning of the reloading process when the threaded shaft 3 rotates clockwise. Then the sliding rods 2*a*, 2*b* move towards threaded shaft 3, and the sliding weight 20 travels down to the bottom of the can as shown in FIG. 5, and stops. At this point, the springs 1*a,b* are under tension and the nut 6*a*, 6*b* holds the sliding part on the shaft.

Figure 6A:
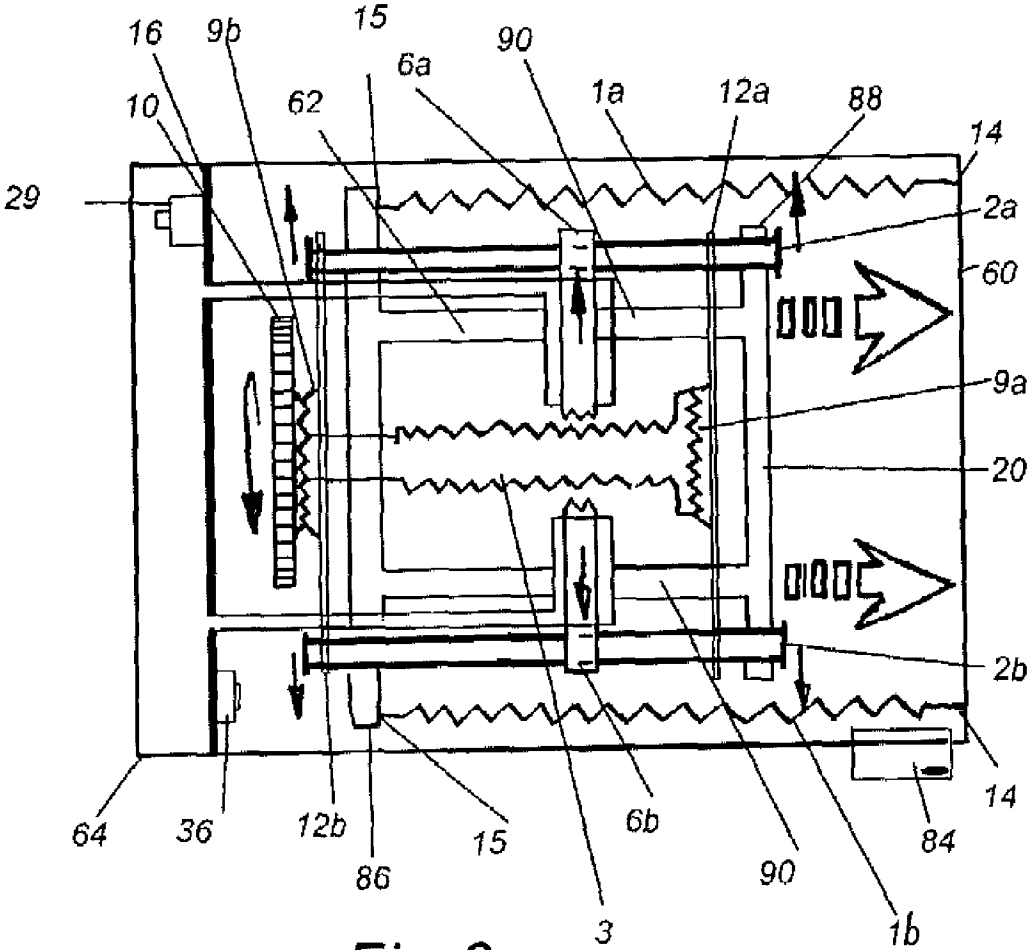
FIG. 6*a* is an elevational view of the inside of the jumping can portion of the invention, showing the counter-clockwise rotation of the threaded bolt.
Figure 6B:
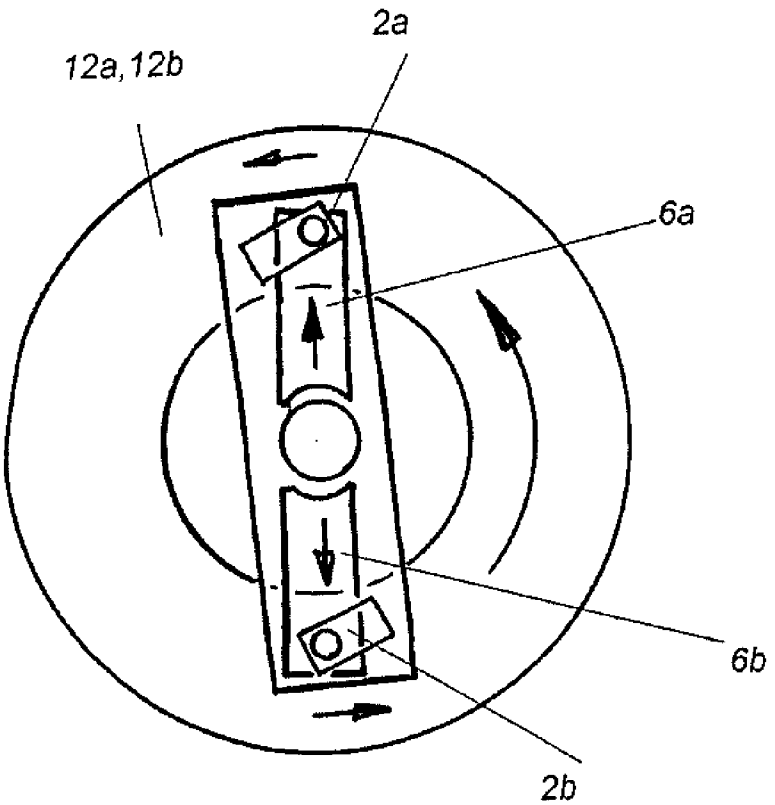
FIG. 6*b* is a top view of the plates with slots of the can shown in FIG. 6*a;*
Figure 7A:
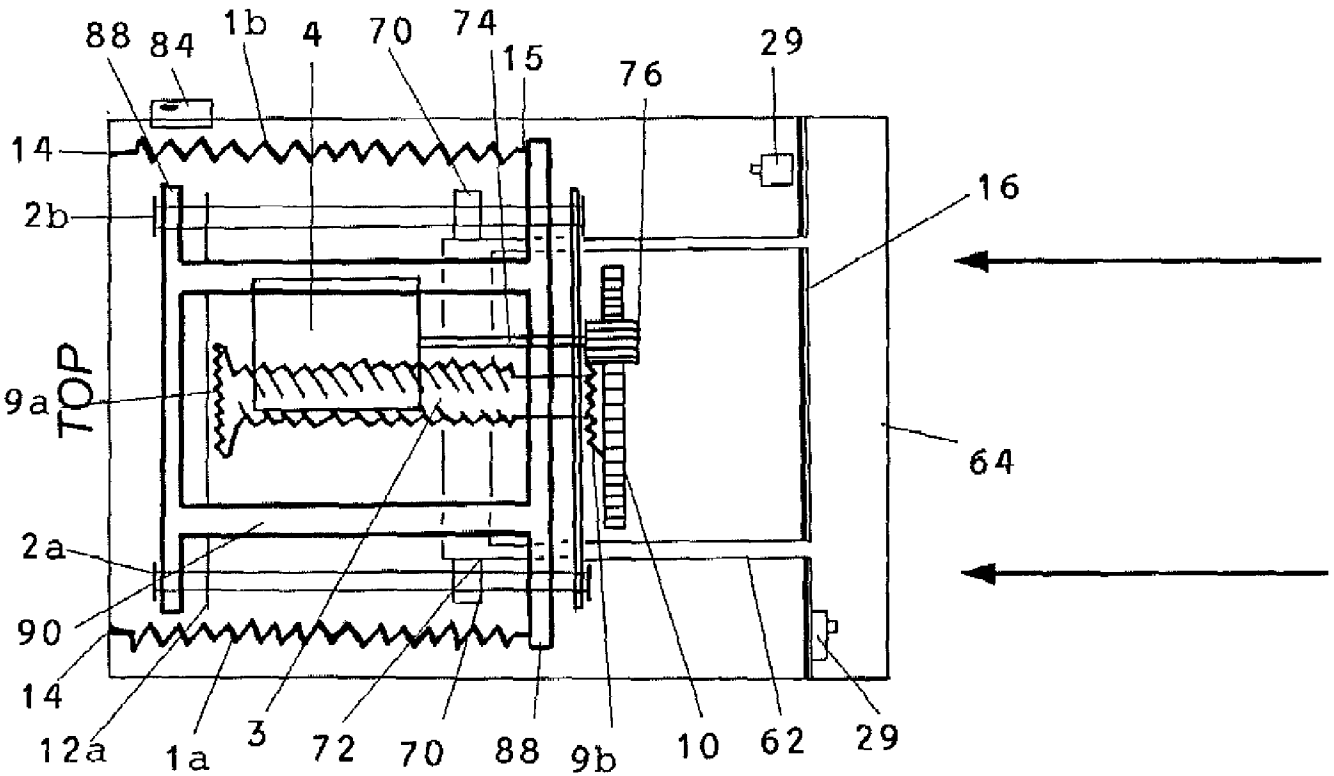
FIG. 7 is an elevational view of the inside of the jumping can portion of the invention, when the mechanism hits the top of the can.

By triggering the motor to rotate counter clockwise, the two plates 13 start to rotate in the same direction and cause sliding rods 2*a*, 2*b* to move apart and then the two parts of nut 6*a*, 6*b* move apart from the threaded shaft 3, as shown on FIG. 6. When the threaded shaft 3 is released from the nuts, then by the springs' tension the whole weight 20 jumps up and hits the top of the can, causing the can to jump as shown on FIG. 7. At this moment, the motor changes direction and reloads the mechanism, so it is ready for next triggering.

In order to operate the motor 4 within the can, there is an electronic circuit. The simplest embodiment of the invention would be for a simple on/off switch. When the switch is "on," the circuit powers the motor and the jumping action is created. This circuit is provided on a circuit board 16 at the bottom of the inside of the can 60.

According to the preferred embodiment, there are sensors 84 on the surface of the can. When these sensors detect the infrared signal from the transmitter or gun, the internal circuitry of the can activates the motor to initiate the jumping action. Any number of sensors may be provided. By increasing the number of sensors, the user facilitates use of the toy. With more sensors, the can may be positioned in a myriad of positions and still receive the signal to jump. If fewer sensors are utilized, then the can will operate in only a more limited number of positions. It may be appreciated that the sensors can only receive the infrared signal when facing the transmitter or gun. By having more sensors, any surface of the can may face the transmitter and still permit reception of the signal. When only a few sensors are used, only certain can positions may be used.

Obviously the transmitter or gun has some electronic circuit to generate the signal for the can to jump. In the preferred embodiment, infrared signals are used, but it may be appreciated that signals of any wavelength or frequency may be used.

Figure 8:
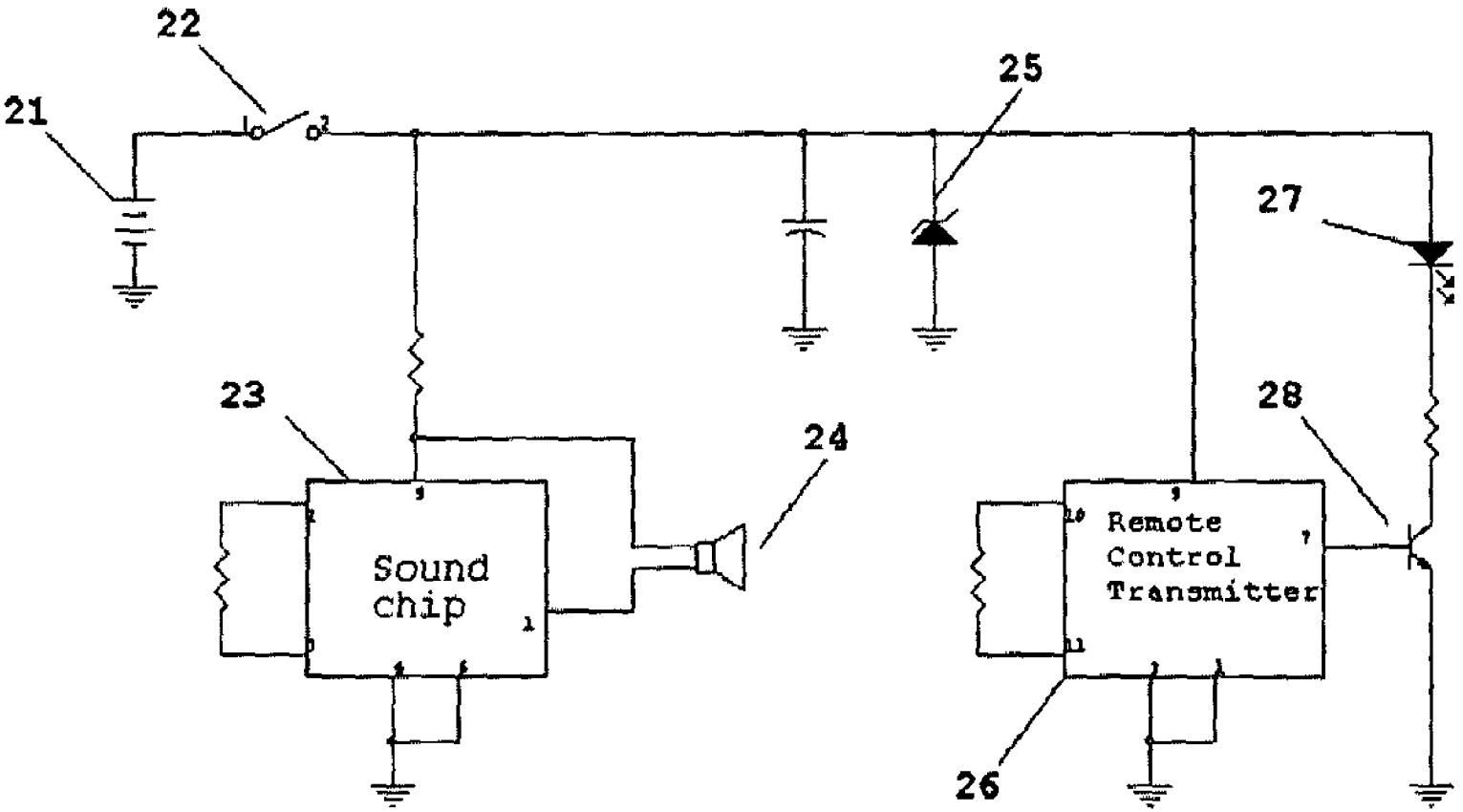
FIG. 8 is an electrical schematic drawing of the transmitter unit.
Figure 9:
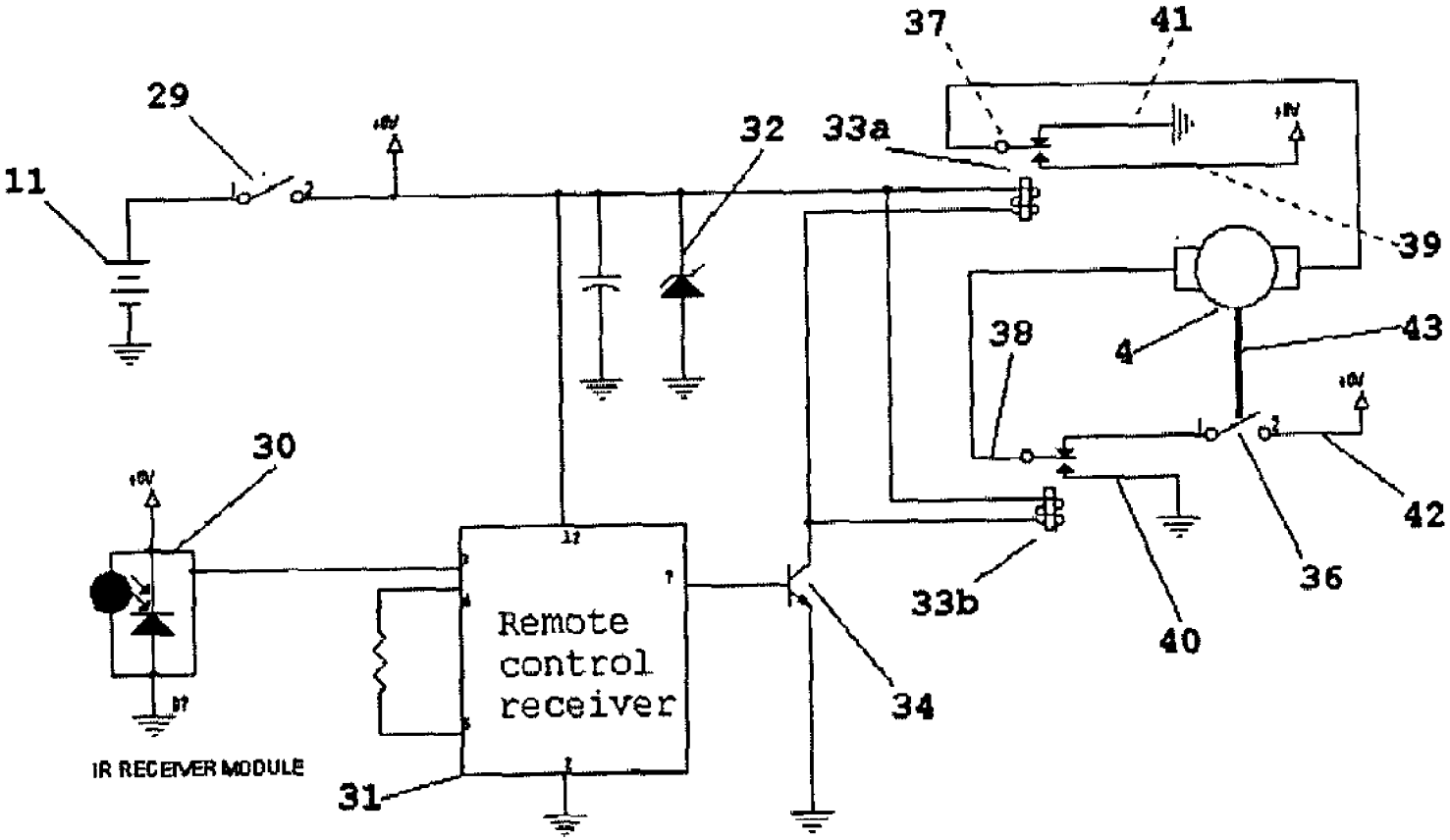
FIG. 9 is an electrical schematic drawing of the receiving unit.

FIG. 8 shows the circuitry for the transmitter and FIG. 9 shows the circuitry for the receiver in the can.

There are two main IC (Electronic integrated circuits) on the gun electronic board. Sound chip IC 23, which generates a shooting sound each time when triggered, and the Remote control transmitter IC 26 that generates a coded signal when triggered. The battery 21 provides the power for the electronic circuit. Each time the trigger 56 (or other on-surface button or activation point) is engaged, the switch 22 is closed. This causes electricity to flow in the circuit. First, this causes the sound chip to generate a noise to simulate any desire effect, such as a bullet hitting the can or a bottle breaking. In addition, the remote control transmitter generates the signal, generally an infrared signal, which activates the circuitry inside the can. Each time the trigger is presses, the circuit is activated.

The Zener diode 25 is used to stabilize and limit the battery voltage provided to the Electronic IC's.

When the gun's trigger is released (normally), the battery 21 voltage does not reach the electronic IC's 23, 26 since the trigger is not pressed and the switch 22 contacts are open. Once the gun's trigger is pressed, switch 22 contacts are closed and the electronic circuit becomes powered. The Sound chip IC 23 then generates an electronic signal to the speaker 24 which sounds a shooting noise. At the same time, the Remote control transmitter IC 26 generates an electronic coded signal to the high current driving transistor 28. This signal drives the IR (Infra Red) transmitting diode 27, which generates an Infra Red light beam to the direction that the gun is aimed.

At the moment the trigger is released, the switch 22 contacts becomes open, and the electronic circuit is powered off.

The purpose of the can's electronic circuit is to trigger the can to jump, each time when hit by the gun's "shooting", and then to reload the mechanism for the next jump.

Inside the can, on the circuit board 16 the electronic circuit is powered by batteries 11 and the voltage is regulated by a Zener diode 32. The electronic switch 29 switches on and off the electronic circuit, for saving power when the toy is not played.

The IR (Infra Red) receiver module is sensitive to the invisible IR light beam, generated by the gun's IR transmitting LED 27, at the time when the trigger 22 is pressed. An appropriate electrical connection is provided between the sensors 84 on the surface of the can and the IR receiver module. This invisible coded light is transformed to an electronic signal and sent to the input of the Remote control receiver 31. This IC recognizes only a known coded string sent by the gun, and, if confirmed, then activates the driving transistor 34. It may also be set to respond to any received signal. This would allow multiple transmitters to be used, but the toy would suffer from the potential problem of being activated by external signals that were not intended for the toy. When the transistor is activated, it switches on the relays 33*a* and 33*b*. This causes the relay to change the position of the common contacts inside 38, 37, in a way that common contact 37 touches Normally open contact 39 and common contact 38 touches Normally open contact 40. This causes the current to flow in a polarity that drives the motor 4 to turn the shaft 3 counter clockwise. When the shaft rotates counter clockwise, it causes the two parts of nut 6*a*, 6*b* to split at once and then the weight is released from the threaded shaft 3 and jumps up, lifting the can with it. When the motor 4 and weight jumps up, it releases the pressure on switch 36, which is located at the bottom of the can. When that happens, the contacts of this switch becomes connected. When the can jumps, the signal from Remote control receiver 31 stops, and the relays 33*a* and 33*b* and common contacts 37 and 38 move to the normally close position, contact 37 touches normally close contact 41 and contact 38 touches contact 42. Since switch 36 is closed (conducting), the motor 4 turns the threaded shaft clockwise. When the threaded shaft 3 rotates clockwise, it causes the nut 6*a*, 6*b* to clamp the threaded shaft, and then the mechanism travels down and the whole weight with it. When the mechanism presses on switch 36, which is located at the bottom of the can, it opens the contacts and the motor stops and waits for the next shooting.

This invention may be used as a single integrated toy with both the transmitter/gun and the jumping toy, or just the jumping can may be used by itself as a single toy.

When implemented as a toy, a plastic gun is operated by batteries. When it is triggered, it transmits out threw the barrel an IR coded light beam, and sounds a shutting noise. This beam activates the can to jump. The typical reactive distance is about 5 meters, but the toy may be embodied for any desired distance.

The plastic can be wrapped with a replaceable target decoration and contains a battery-operated mechanism. Each time it senses a coded signal of IR light transmission, it causes a jumping of the can and sounds a braking glass noise. When the can falls on its side, it stands back up vertically again and it is ready for the next jumping immediately.

In an alternate embodiment, a light guide may be used on the surface of the target or can to direct the activation or infrared signal to the sensors 84.

The invention is described in detail with reference to a particular embodiment, but it should be understood that various other modifications can be effected and still be within the spirit and scope of the invention.

We claim:

1. An interactive toy for simulating a shooting action, comprising:

a transmitter for generating an activation signal; and a target having a sensor for receiving said activation signal and a means for moving the target that is activated upon reception of said activation signal, wherein said means for moving said target comprises a frame arranged in said toy for movement along a vertical axis of said toy; a threaded shaft vertically positioned in said frame; a motor on said frame kinetically connected to said shaft to selectively rotate said shaft in a clockwise or a counter clockwise direction and said sensor being electrically connected to said motor; half nuts positioned around said shaft for movement into and out of contact with said shaft; plates with slots secured to ends of said shaft; sliding rods having ends engaging said slots on said plates and intermediate portions of said sliding rods bearing on said half nuts to move said half nuts into and out of contact with said shaft; and springs having one end connected to said frame and one end connected to an inside top surface of said device.

2. A toy according to claim 1, wherein clockwise movement of said shaft causes said frame to move downward in said toy, and counter-clockwise movement of said shaft causes said half nuts to move away from said shaft, thereby causing released energy from said springs to cause said frame to move up quickly within the toy.

3. A toy according to claim 1, wherein said activation signal is an infrared signal.

4. A toy according to claim 2, wherein said activation signal is an infrared signal.

5. A toy according to claim 1, further comprising a gear train for communicating rotational motion from said motor to said shaft.

6. A toy according to claim 2, further comprising a gear train for communicating rotational motion from said motor to said shaft.

7. A device for causing an object to move in a desired plane, comprising a frame arranged in said device for movement along a vertical axis of said device; a threaded shaft vertically positioned in said frame; a motor on said frame kinetically connected to said shaft to selectively rotate said shaft in a clockwise or a counter clockwise direction; half nuts positioned around said shaft for movement into and out of contact with said shaft; plates with slots secured to ends of said shaft; sliding rods having ends engaging said slots on said plates and intermediate portions of said sliding rods bearing on said half nuts to move said half nuts into and out of contact with said shaft; and springs having one end connected to said frame and one end connected to an inside top surface of said device.

8. A device according to claim 7, wherein clockwise movement of said shaft causes said frame to move downward in said device, and counter-clockwise movement of said shaft causes said half nuts to move away from said shaft, thereby causing released energy from said springs to cause said frame to move up quickly within the device.

9. A device according to claim 7, further comprising sensing means for receiving an external activation signal and electrically connected to said motor.

10. A device according to claim 8, further comprising sensing means for receiving an external activation signal and electrically connected to said motor.

11. A device according to claim 7, further comprising a gear train for communicating rotational motion from said motor to said shaft.

12. A device according to claim 8, further comprising a gear train for communicating rotational motion from said motor to said shaft.

13. A device according to claim 9, further comprising a gear train for communicating rotational motion from said motor to said shaft.

14. A device according to claim 9, further comprising a light guide directing the activation signal to said sensing means.

15. A toy according to claim 1, further comprising a light guide on said target and directing the activation signal to said sensor.

* * * * *